US006530745B2

(12) United States Patent
Ciani

(10) Patent No.: US 6,530,745 B2
(45) Date of Patent: Mar. 11, 2003

(54) COOLING SYSTEM FOR GAS TURBINE STATOR NOZZLES

(75) Inventor: Alessandro Ciani, Florence (IT)

(73) Assignee: Nuovo Pignone Holding S.p.A., Florence (IT)

( * ) Notice: Subject to any disclaimer, the term of this patent is extended or adjusted under 35 U.S.C. 154(b) by 0 days.

(21) Appl. No.: 09/987,331

(22) Filed: Nov. 14, 2001

(65) Prior Publication Data

US 2002/0064452 A1 May 30, 2002

(30) Foreign Application Priority Data

Nov. 28, 2000 (IT) ..... MI2000A002555

(51) Int. Cl.[7] ..... F01D 9/06
(52) U.S. Cl. ..... 415/115; 416/97 R
(58) Field of Search ..... 415/115, 116; 416/96 R, 96 A, 97 R

(56) References Cited

U.S. PATENT DOCUMENTS 3,738,771 A * 6/1973 Delarbre et al. ..... 416/96 R
4,297,077 A * 10/1981 Durgin et al. ..... 416/97 R
5,352,091 A * 10/1994 Sylvestro ..... 416/96 A
5,368,441 A * 11/1994 Sylvestro et al. ..... 416/97 R
5,503,527 A * 4/1996 Lee et al. ..... 416/97 R
5,681,144 A * 10/1997 Spring et al. ..... 416/97 R
6,179,565 B1 * 1/2001 Palumbo et al. ..... 416/97 R
6,190,120 B1 * 2/2001 Thatcher et al. ..... 415/115

FOREIGN PATENT DOCUMENTS

JP 3-182602 A * 8/1991 ..... 416/97 R

* cited by examiner

*Primary Examiner*—Christopher Verdier
(74) *Attorney, Agent, or Firm*—Nixon & Vanderhye

(57) ABSTRACT

A cooling system for gas turbine stator nozzles, wherein each of the vanes which belong to the nozzles of the gas turbine has a concave surface and an opposite convex surface, which cooperate in order to define the outer shape of the vane, and wherein the surface of the vane has a plurality of cooling holes, at appropriate points of the surface itself of the vane. In this system, the cooling hole relative to the outlet edge of the vane is provided with an intake section and an outlet section, which are shaped such that the cooling hole has a cross-section which is variable in a direction which is radial relative to the vane.

8 Claims, 3 Drawing Sheets

COOLING SYSTEM FOR GAS TURBINE STATOR NOZZLES

Figure 1:
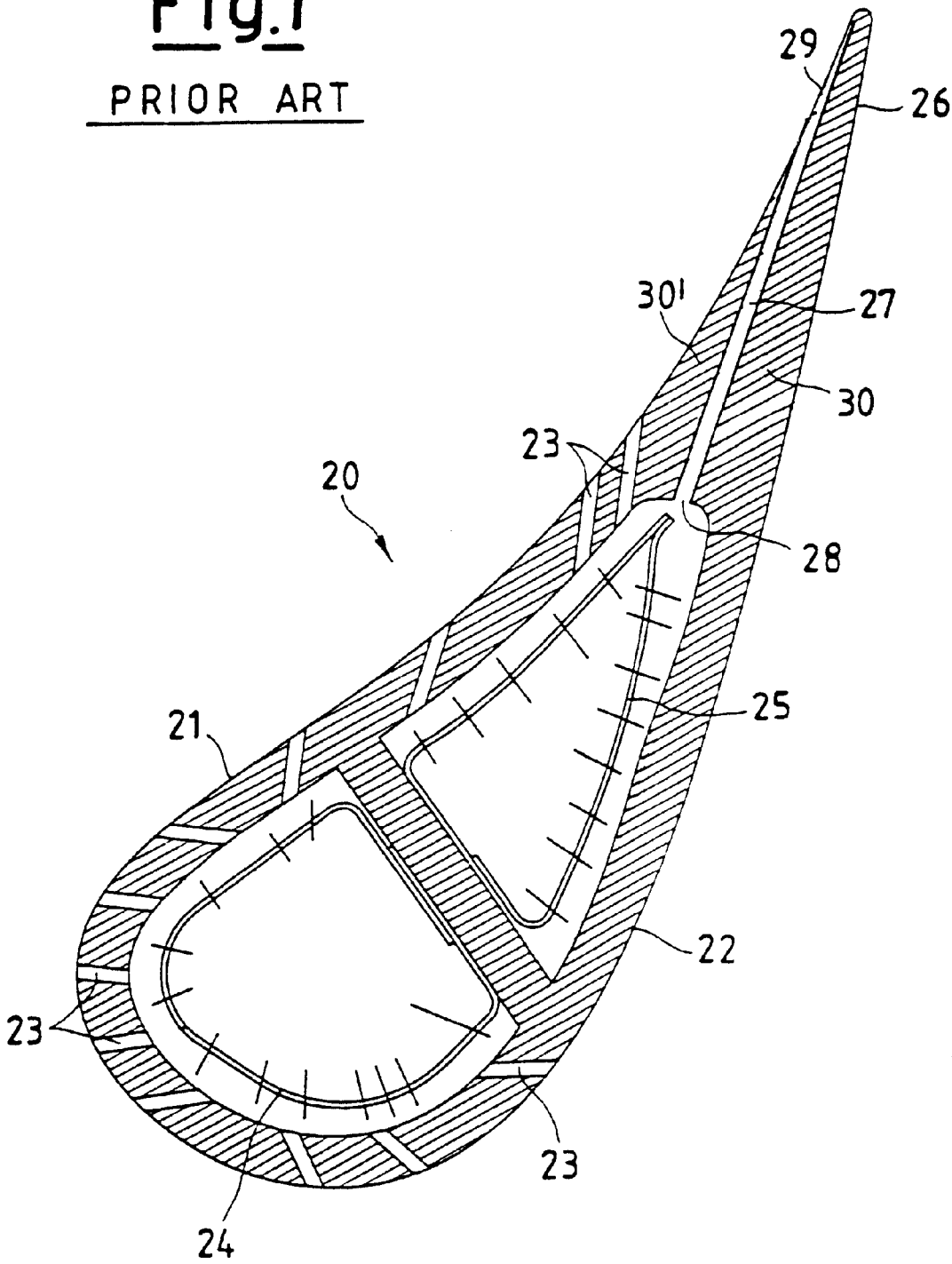
Fig.1 PRIOR ART

The present invention relates to a cooling system for gas turbine stator nozzles.

As is known, gas turbines are machines which consist of a compressor and a turbine with one or more stages, wherein these components are connected to one another by a rotary shaft, and wherein a combustion chamber is provided between the compressor and the turbine.

In these machines, air obtained from the outer environment is supplied to the compressor, in order to pressurise the latter.

The compressed air passes through a series of pre-mixing chambers, each of which ends in a converging portion, into each of which an injector supplies fuel, which is mixed with the air in order to form an air—fuel mixture to be burnt.

Inside the combustion chamber there is admitted the fuel, which is ignited by means of appropriate spark plugs, in order to give rise to combustion, which is designed to increase the temperature and pressure, and thus the enthalpy of the gas.

Simultaneously, the compressor supplies compressed air, which is made to pass both through the burners and through the liners of the combustion chamber, such that the said compressed air is available in order to feed the combustion. Subsequently, via appropriate pipes, the high-temperature and high-pressure gas reaches the different stages of the turbine, which transforms the enthalpy of the gas into mechanical energy available to a user.

At this point, it is also known that, in order to obtain the maximum performance from a specific gas turbine, it is necessary for the temperature of the gas to be as high as possible; however, the maximum temperature values which can be achieved in use of the turbine are limited by the resistance of the materials used.

In order to make more apparent the technical problems which are solved by the present invention, a brief description is provided hereinafter of a stator of a high-pressure stage of a gas turbine according to the known art.

Downstream from the combustion chamber, the turbine has a high-pressure stator and a rotor, wherein the stator is used to feed the flow of burnt gases in suitable conditions to the intake of the rotor, and, in particular, to convey it correspondingly to the vanes of the rotor blades, thus preventing the flow from meeting directly the dorsal or convex surface and the ventral or concave surface of the blades.

The stator consists of a series of stator blades, between each pair of which a corresponding nozzle is provided.

The group of stator blades is in the form of a ring, and is connected externally to the turbine casing, and internally to a corresponding support.

In this respect, it can be noted that a first technical problem of the stators, in particular in the case of the high-pressure stages, consists of the fact that the stator is subjected to high-pressure loads, caused by the reduction of pressure of the fluid which expands in the stator vanes.

In addition, the stator is subjected to high temperature gradients, caused by the flow of hot gases obtained from the combustion chamber, and by the flows of cold air which are introduced inside the turbine in order to cool the parts which are subjected to the greatest stresses from the thermal point of view.

Owing to these high temperatures, the stator blades used in the high-pressure stage of the turbines must be cooled, and, for this purpose, they have a surface which is correspondingly provided with holes, which are used for circulation of air inside the stator blade itself.

However, in this context, it should be noted that the constant requirement for increases in the performance of gas turbines makes necessary optimisation of all the flows inside turbine engines.

In particular, since the air which is obtained from the compression stages has been processed as described, with a considerable increase in the thermodynamic cycle, it is advantageous for this air to be used as far as possible for combustion instead of for cooling functions, which moreover is necessary in the most critical hot areas.

An important technical problem which arises in this context thus consists of correct metering of this air in the various areas, taking into account the fact that the amount of air required varies according to the functioning conditions, the age and the level of wear or dirtiness of the turbine engine and its parts, as well as to the dimensional variations of its components during the transitory functioning states.

Parts which are subjected to particular stress from the thermal point of view are the stator nozzles, the design of which must meet the fluid mechanics requirements necessary in order to obtain a high level of fluid mechanics efficiency of the machine.

The design must also meet the thermal requirements, in order firstly to limit the temperature of the metal to below a certain value, which is determined by the materials used (and can be 900° C.), and secondly to limit the temperature gradients which are present in the material.

In order to assist understanding of the characteristics of the present invention, particular reference is now made to FIG. 1, which represents in longitudinal cross-section a vane 20, which belongs to a nozzle of a gas turbine according to the known art.

The vane 20 has a concave or ventral surface 21, and an opposite convex or dorsal surface 22, which cooperate in order to define the outer shape of the vane 20.

A plurality of cooling holes 23 are also provided, shown at appropriate points on the surface of the vane 20.

These holes or slots in fact serve the purpose of cooling the end part of the nozzle itself. Inside the vane 20, there are also present small boxes 24 and 25, i.e. perforated plate elements which increase the coefficient of heat exchange to values which are acceptable for the current applications (3000 $W/m^2K$).

In fact, this part of the vane of the nozzles must maintain limited temperatures, but at the same time the consumption of relatively cold air obtained from the compressor must be limited (for example it must be 5–10%), in order not to detract from the performance levels of the entire machine.

At the outlet edge 26 of the vane 20, there is also present a cooling hole 27, which has an intake section 28 and an outlet section 29 shown in FIG. 1.

The known art thus has the problem of a thickness of material which is excessive or too great in the vicinity of the cooling hole of the outlet edge of the vane 20.

This quantity of material, which is indicated as 30 and 30' in FIG. 1, generally has in its interior temperature gradients which are difficult to eliminate, although it is possible to increase the coefficients of local heat exchange, to take them to values which are very high.

It should be noted however that when the intake section of the holes is enlarged at the outlet edge, there is elimination of material which has high thermal gradients, but at the same time there is reduction of the speed of the cooling air, and consequently of the coefficient of heat exchange which occurs in the holes or slots of the vane 20, on the understanding that this comparison must be made for the same flow rate of cooling air.

This therefore shows the risk constituted by having an excessively high temperature of the metal, in relation to the physical properties of the material of the nozzle.

The object of the invention is thus to provide a cooling system for stator nozzles of gas turbines, which makes it possible to obtain optimum control of the temperature of the vanes of these nozzles.

Another object of the invention is to provide a cooling system for stator nozzles of gas turbines, which makes it possible to eliminate the undesired temperature gradients within the vanes.

A further object of the present invention is to provide a cooling system for stator nozzles of gas turbines, which makes it possible to reduce the large thickness of material in the vicinity of the cooling hole of the outlet edge of the vanes.

These objects and others according to the invention are achieved by a cooling system for gas turbine stator nozzles, which is applicable to the vanes which belong to the nozzles of a gas turbine, wherein each of the said vanes has a concave surface and an opposite, convex surface, which co-operate in order to define the outer shape of the vane, and wherein the surface of the said vane has a plurality of cooling holes, at appropriate points of the surface of the said vane, characterised in that the cooling hole, relative to the outlet edge of the said vane, is provided with an intake section and an outlet section, which are shaped such that the cooling hole has a cross-section which is variable in a direction which is radial, relative to the said vane.

Figure 3:
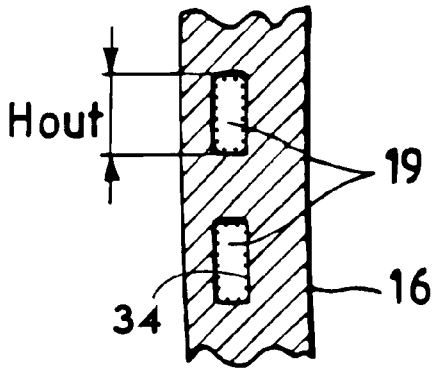

According to a preferred embodiment of the present invention, the height of the intake section (Hin in FIG. 4), along a radial direction of the vane, of the cooling hole of the outlet edge of the vane, is less than the relative height of the outlet section (Hout in FIG. 3).

According to a preferred embodiment of the present invention, inside the said vane there are present undulating elements, in order to increase the coefficient of heat exchange of the said vane.

The system according to the invention has high coefficients of heat exchange along the entire cooling hole, and the absence of temperature gradients inside the metal of the said vane.

According to the invention, the cooling system of the nozzles has a plurality of elements for creation of turbulence along the walls of the holes themselves, in order always to guarantee a high value of the coefficient of heat exchange.

In addition, the cooling system of the nozzles has a low loss of load, which is localised to the mouth of the said hole, such as to avoid wasting part of the total pressure of the adjustment air in this area, leaving the cooling fluid more energy to overcome the loss of load of the cooling holes and of the elements for creation of turbulence.

Finally, it should be noted that the geometry of the said hole is such as to facilitate intake of the molten alloy during casting of the said vane.

Further characteristics of the invention are defined in the other claims attached to the present application.

Figure 2:
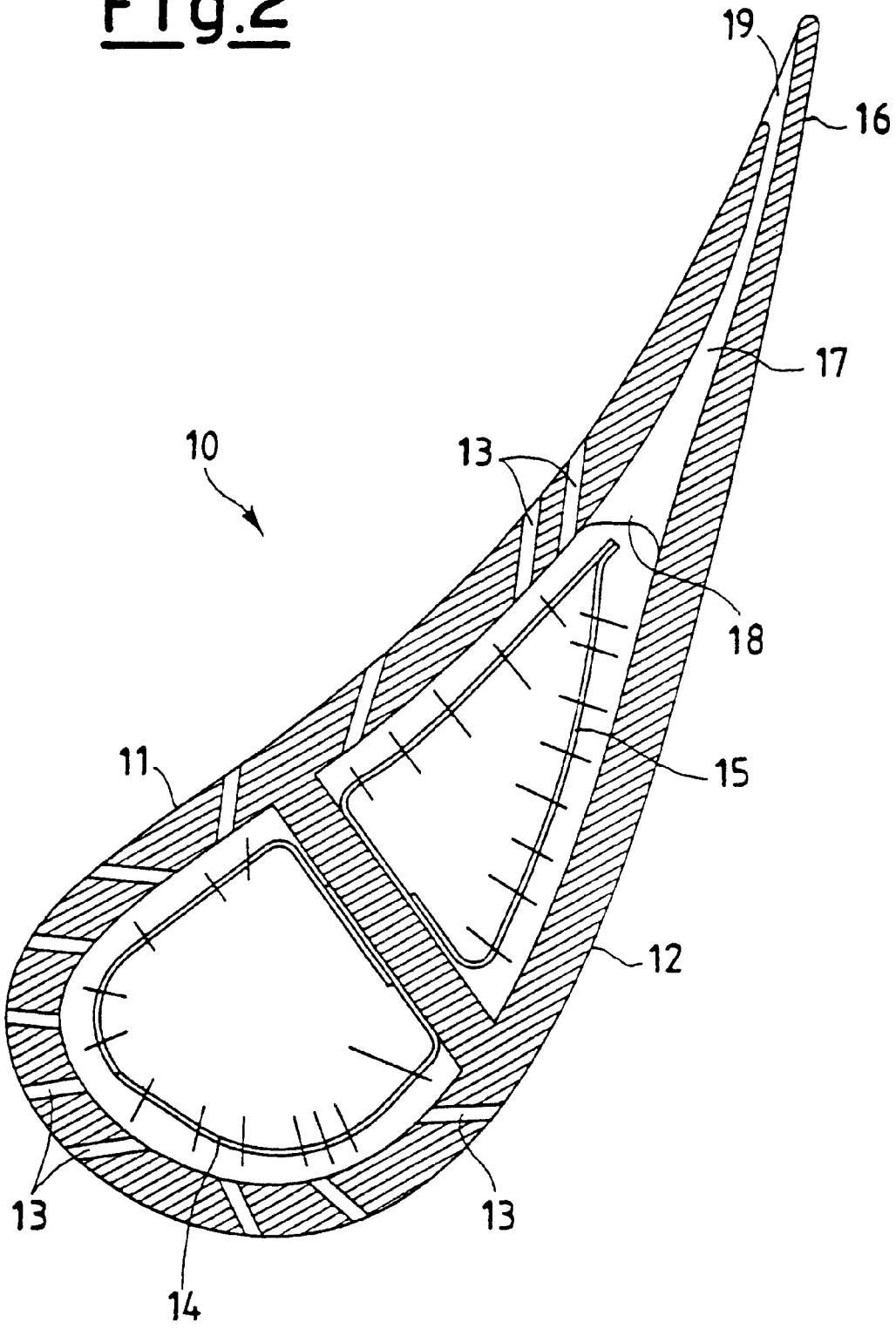
Figure 4:
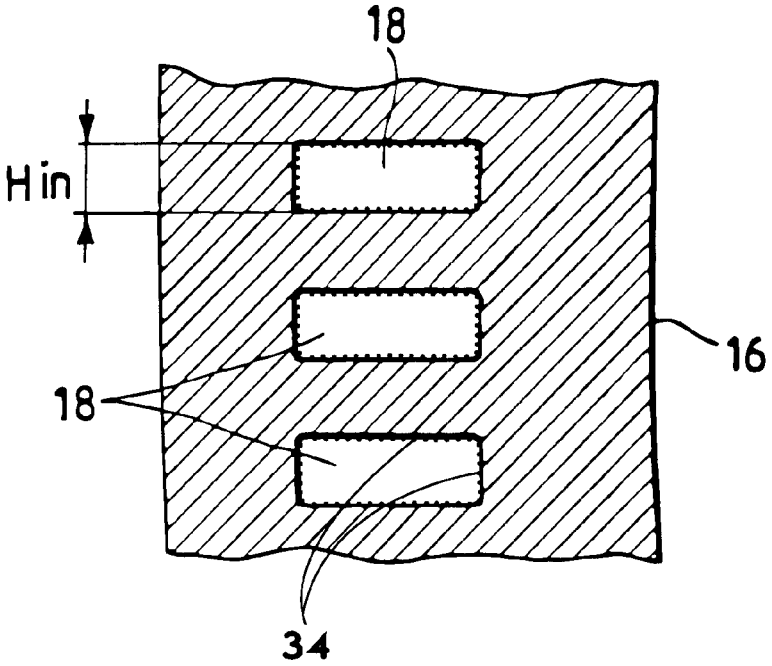

The characteristics and advantages of the present invention will become more apparent from the following description of a typical embodiment provided by way of non-limiting example, with reference to the attached schematic drawings, in which:

FIG. 1 represents schematically, in longitudinal cross-section, a vane which belongs to a nozzle of a gas turbine, according to the known art;

FIG. 2 on the other hand represents in longitudinal cross-section a vane which belongs to a nozzle of a gas turbine, according to the present invention;

FIG. 3 represents in radial cross-section the output section of the cooling holes of a nozzle of a gas turbine, according to the present invention; and FIG. 4 represents in radial cross-section the input section of the cooling holes of a nozzle of a gas turbine, according to the present invention.

In the present description, "radial direction" refers in particular to a direction perpendicular to the flow of gas which expands in the machine.

In some cases, the direction of the flow of gas is also the direction of the main axis of the machine.

With particular reference above all to FIG. 2, this figure shows in longitudinal cross-section a vane, indicated globally by the reference number 10, which belongs to a nozzle of a gas turbine, according to the present invention.

The shape of the vane 10 is particularly designed to provide the required aerodynamic properties with reference to the gases which are processed by the turbine, and has a concave or dorsal surface 11, and an opposite, convex or ventral surface 12, which co-operate in order to define the outer shape of the vane 10.

There are also provided a plurality of cooling holes 13, which are present at appropriate points of the surface of the vane 10.

Inside the vane 10, there are also present small boxes 14 and 15, i.e. perforated plate elements which increase the coefficient of heat exchange to values which are acceptable for the current applications.

Of particular importance for the purposes of the present invention is the output edge 16 of the vane 10, inside which there is provided a cooling hole 17, which has an intake section 18 which is enlarged compared with the known art.

FIG. 2 also shows the outlet section 19 of the cooling hole 17, in the part in which the vane 10 becomes thinner.

Consequently, with this configuration, an enlargement of the intake section 18 of the cooling holes 17 of the vanes 10 is obtained.

In order to eliminate this disadvantage, the cooling holes, which usually have a constant cross-section, can have a height which is variable in the radial direction.

In fact, if the intake of the cooling hole is wider (area 18 in FIG. 2) in the plane in the figure, the dimension at right-angles to the plane itself (radial direction for the machine) can be smaller than in the conventional applications.

In fact, the intake section 18 of the cooling hole 17 of the outlet edge 16 of the vane 10 has a dimension (indicated as Hin in FIG. 4) which is smaller than the corresponding dimension (indicated as Hout in FIG. 3) of the outlet section 19.

If the cooling system for the nozzle, according to the invention in question, is also characterised by having the same dimension of the cooling hole in the vicinity of the output edge of the vane (area 29 in FIG. 1 and area 19 in FIG. 2), this will assume a purely three-dimensional form, with the intake section 18 and the outlet section 19 indicated in FIGS. 3–4.

By means of this geometry it is therefore possible to have high coefficients of heat exchange along the entire cooling hole 17, thus eliminating the temperature gradients inside the metal of the vane.

A further improvement of the heat exchange can also be achieved by using elements for creation of turbulence along the walls of the holes themselves, in order always to guarantee a high value of the coefficient of heat exchange. Such elements may comprise protuberances 34 along the walls of the cooling holes as illustrated in FIGS. 3 and 4.

An additional advantage of the invention is represented by the reduced loss of load localised at the mouth of the hole, which makes it possible not to waste part of the total pressure of the adjustment air in this area, thus leaving the cooling fluid more energy in order to overcome the loss of load of the cooling holes and of the elements for creation of turbulence.

Another advantage of the invention occurs during casting of the vane, wherein the geometry in question forms a type of funnel in the mouth area of the slots, which facilitates the intake of the molten alloy.

The theoretical and experimental results of the present invention have been so satisfactory that the system can be used for new gas turbines which are widely available.

The description provided makes apparent the characteristics and advantages of the cooling system for gas turbine stator nozzles, according to the present invention.

The following concluding comments and observations are now made, such as to define the said advantages more clearly and accurately.

The object of the solution proposed is to reduce the large thickness of material in the vicinity of the cooling hole of the outlet edge of the vane.

The present invention thus consists of eliminating the said areas of large thickness of material, at the same time also eliminating the corresponding temperature gradients.

This gives rise to the advantageous consequences previously illustrated with reference to the reduced loss of load localised at the mouth of the hole 17, in order to avoid wasting part of the total pressure of the adjustment air in this particularly critical area.

The geometry of the hole 17 is such as to facilitate the intake of the molten alloy during casting of the vane 10.

Finally, it is apparent that many other variations can be made to the cooling system for gas turbine stator nozzles which is the subject of the present invention, without departing from the principles of novelty which are inherent in the inventive concept.

It is also apparent that in the practical embodiment of the invention, any materials, dimensions and forms can be used according to requirements, and the components themselves can be replaced by other components which are technically equivalent.

The scope of the prevent invention is defined by the attached claims.

What is claimed is:

1. A cooling system for gas turbine stator nozzles, comprising:

a plurality of vanes forming a plurality of nozzles for a gas turbine;

each said vane having a concave surface and an opposite convex surface which cooperate with one another to define the outer shape of the vane;

said vane including a plurality of cooling holes in communication with a cooling medium within said vane and opening through said concave vane surface, each said cooling hole having an inlet section within said vane and an outlet section opening through said concave surface;

said cooling hole having a cross-section variable in a radial direction, said inlet section having a height along a generally radial direction of said vane less than a height of the outlet section, a width of the inlet section being greater than a width of the outlet section, whereby a wall thickness between the cooling hole and the concave surface in the region of the outlet section is minimized.

2. A cooling system according to claim 1 including perforated plate elements within said vane for receiving the cooling medium to increase the coefficient of heat exchange of said vane.

3. A cooling system according to claim 1 including a plurality of elements along the walls of the holes for creating turbulence in the flow of the cooling medium along the cooling holes to provide a high value of the coefficient of heat exchange.

4. A cooling system according to claim 1 wherein the intake section flares outwardly within the vane in an upstream direction relative to the direction of the cooling medium flow through the cooling hole.

5. A cooling system for gas turbine stator nozzles, comprising:

a plurality of vanes forming a plurality of nozzles for a gas turbine;

each said vane having a concave surface and an opposite convex surface which cooperate with one another to define the outer shape of the vane;

said vane including a plurality of cooling holes in communication with a cooling medium within said vane and opening through said concave vane surface, each said cooling hole having an inlet section within said vane with a major axis normal to a generally radial direction of the vane and an outlet section opening through said concave surface with a major axis generally normal to the major axis of the inlet section.

6. A cooling system according to claim 5 including perforated plate elements within said vane for receiving the cooling medium to increase the coefficient of heat exchange of said vane.

7. A cooling system according to claim 5 including a plurality of elements along the walls of the holes for creating turbulence in the flow of the cooling medium along the cooling holes to provide a high value of the coefficient of heat exchange.

8. A cooling system according to claim 5 wherein the intake section flares outwardly within the vane in an upstream direction relative to the direction of the cooling medium flow through the cooling hole.

* * * * *